US011047154B2

(12) United States Patent
Kim et al.

(10) Patent No.: US 11,047,154 B2
(45) Date of Patent: Jun. 29, 2021

(54) LOCKING DEVICE FOR CONTAINERS

(71) Applicant: Korea Railroad Research Institute, Uiwang-si (KR)

(72) Inventors: Hag Seoung Kim, Hwaseong-si (KR); Yong Jang Kwon, Seoul (KR); Young Joo Kim, Anyang-si (KR); Sung Wook Kang, Seoul (KR); Young Ho Rhee, Suwon-si (KR)

(73) Assignee: KOREA RAILROAD RESEARCH INSTITUTE, Uiwang-si (KR)

( * ) Notice: Subject to any disclaimer, the term of this patent is extended or adjusted under 35 U.S.C. 154(b) by 686 days.

(21) Appl. No.: 15/736,903

(22) PCT Filed: Oct. 13, 2016

(86) PCT No.: PCT/KR2016/011487
§ 371 (c)(1),
(2) Date: Dec. 15, 2017

(87) PCT Pub. No.: WO2017/095015
PCT Pub. Date: Jun. 8, 2017

(65) Prior Publication Data

US 2018/0171685 A1 Jun. 21, 2018

(30) Foreign Application Priority Data

Dec. 3, 2015 (KR) ..... 10-2015-0171693

(51) Int. Cl.
*B65D 90/00* (2006.01)
*E05B 83/02* (2014.01)
(Continued)

(52) U.S. Cl.
CPC ..... *E05B 83/02* (2013.01); *B63B 25/00* (2013.01); *B65D 88/124* (2013.01);
(Continued)

(58) Field of Classification Search
CPC ..... B65D 90/0013; B65D 90/002; B65D 90/0026; Y10T 403/7005; Y10T 24/28
See application file for complete search history.

(56) References Cited

U.S. PATENT DOCUMENTS 3,386,696 A * 6/1968 Duval ..... B60P 7/132 24/287
3,556,456 A * 1/1971 Lunde ..... B65D 90/0006 410/84

(Continued)

FOREIGN PATENT DOCUMENTS

CN 1884011 A 12/2006
CN 101024442 A 8/2007

(Continued)

OTHER PUBLICATIONS

International Search Report for PCT/KR2016/011487 dated Jan. 16, 2017.

*Primary Examiner* — Michael P Ferguson
(74) *Attorney, Agent, or Firm* — Pearne & Gordon LLP

(57) ABSTRACT

The present disclosure suggests a locking device for containers. A locking device for containers according to an exemplary embodiment of the present disclosure includes: a housing including a base part, a protrusion protruded upwards from an upper surface of the base part, and a through hole formed by penetrating the base part and the protrusion in a vertical direction; a connection part rotatably inserted into the through hole of the housing; an upper cone positioned on the connection part and inserted into a lower corner fitting of a first container positioned on an upper end; and a lower cone positioned under the connection part and inserted into an upper corner fitting of a second container positioned on a lower end.

9 Claims, 17 Drawing Sheets

(51) Int. Cl.
*B63B 25/00* (2006.01)
*B65D 88/12* (2006.01)
*B65D 90/22* (2006.01)

(52) U.S. Cl.
CPC ..... *B65D 88/129* (2013.01); *B65D 90/0013* (2013.01); *B65D 90/22* (2013.01); *Y10T 403/7005* (2015.01)

(56) References Cited

U.S. PATENT DOCUMENTS 3,592,495 A * 7/1971 Fisher ..... E05C 19/066 292/76
3,752,511 A * 8/1973 Racy ..... F16B 21/02 24/287
4,321,000 A * 3/1982 Novak ..... B65D 90/0013 248/351
4,591,307 A * 5/1986 Clive-Smith ..... B60P 7/132 24/287
5,012,560 A * 5/1991 Janke ..... B65D 90/0013 24/287
5,462,188 A * 10/1995 Yurgevich ..... B65D 90/0013 206/511
6,113,305 A 9/2000 Takaguchi
2010/0018017 A1* 1/2010 Joo ..... B65D 90/0013 24/697.1

FOREIGN PATENT DOCUMENTS

| | | | |
|---|---|---|---|
| CN | 101633430 | A | 1/2010 |
| CN | 102296701 | A | 12/2011 |
| CN | 103183189 | A | 7/2013 |
| CN | 103754512 | A | 4/2014 |
| EP | 2 818 429 | A1 | 12/2014 |
| JP | 2010-052757 | A | 3/2010 |
| KR | 20-0299022 | Y1 | 12/2002 |
| KR | 10-0850584 | B1 | 8/2008 |
| KR | 10-0904591 | B1 | 6/2009 |
| KR | 10-2010-0090715 | A | 8/2010 |

* cited by examiner

LOCKING DEVICE FOR CONTAINERS

TECHNICAL FIELD

The present disclosure relates to a locking device for containers.

BACKGROUND

In general, a container includes four corner beams as supports and panels each having a predetermined area as six surfaces, i.e., front, rear, left, right, top, and bottom surfaces, between the supports and interlocked and assembled by welding or using a fastening means such as rivet to form a space therein for transport or storage of freight.

In a container, a corner fitting is positioned at each corner. The corner fitting is used to fasten a container to a container transport device when the container is moved to a predetermined position and also used to fix containers positioned adjacent to each other.

Further, when stored or transported on a ship or the like, multiple containers are stacked and loaded in multiple stages in a vertical direction. In this case, the containers stacked in a vertical direction are fixed using a container locking device at each corner fitting, so that the containers cannot fall down by swings of the ship or external shocks.

As for a conventional container locking device, a main body is positioned between container corner fittings and upper and lower fastening units connected to the main body are inserted and fixed to a lower corner fitting of an upper end container and an upper corner fitting of a lower end container, respectively, to connect and fix the upper end container and the lower end container.

Therefore, if the conventional container locking device is used when multiple containers are stacked vertically to be stored or transported on a ship or truck, the main body of the locking device is positioned between the containers and thus unnecessarily requires a space.

Further, as for foldable containers used for improving the efficiency in transport and storage of empty containers without freight, multiple folded containers are grouped in a bundle in order not to make an unnecessary space when transported and stored.

Furthermore, when multiple containers are stacked using the conventional container locking device, it is difficult to visually check whether or not the container locking device is properly fastened, and, thus, there is a risk of safety accident.

Moreover, as for the conventional container locking device, a fastening fixing device can be released even by a small shock during storage and transport, and, thus, special attention thereto is required when containers are transported and stored.

In this regard, Korean Patent Laid-open Publication No. 10-2010-0090715 (entitled "Container connector") discloses a case positioned between containers, a shaft rotatably inserted through the case, an upper cone provided on an upper end of the shaft and inserted into a lower corner casting of an upper end container, a lower cone provided on a lower end of the shaft and inserted into an upper corner casting of a lower end container, a shaft rotation operating means configured to rotate the shaft in a first rotation direction by manual operation, a return spring configured to return the shaft, and a shaft rotation stopping means configured to stop the shaft at a predetermined rotational position by manual operation.

DISCLOSURE OF THE INVENTION

Problems to be Solved by the Invention

The present disclosure is conceived to solve the above-described problem of the conventional technology and provides a locking device for containers which is excellent in space utilization when containers are stacked, maintains a fastening state even under external shock, and makes it possible to visually check the fastening state from the outside.

Means for Solving the Problems

As a means for solving the above-described technical problem, a locking device for containers according to an aspect of the present disclosure includes: a housing including a base part, a protrusion protruded upwards from an upper surface of the base part, and a through hole formed by penetrating the base part and the protrusion in a vertical direction; a connection part rotatably inserted into the through hole of the housing; an upper cone positioned on the connection part and inserted into a lower corner fitting of a first container positioned on an upper end; and a lower cone positioned under the connection part and inserted into an upper corner fitting of a second container positioned on a lower end.

Effects of the Invention

According to the aspects of the present disclosure, a locking device for containers is fully inserted and fixed to a hole formed in a corner fitting of a container, and, thus, a space is not formed by the locking device between the container and a container vertically adjacent thereto. Therefore, it is possible to maximize space utilization.

Further, a user can more stably maintain a fastening state of containers even under shock applied to the containers and a locking device for containers by using a fastening fixing unit and can also visually check the fastening state of containers at long range. Therefore, it is possible to suppress safety accidents in advance.

MODE FOR CARRYING OUT THE INVENTION

Figure 1:
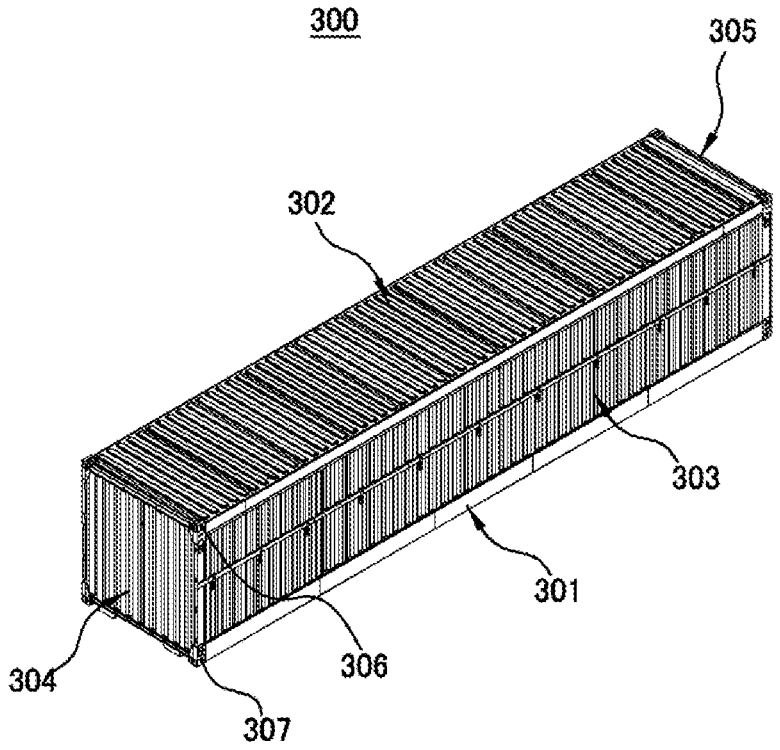
FIG. 1 is a perspective view of a container.

Hereinafter, embodiments of the present disclosure will be described in detail with reference to the accompanying drawings so that the present disclosure may be readily implemented by those skilled in the art. However, it is to be noted that the present disclosure is not limited to the embodiments but can be embodied in various other ways. In drawings, parts irrelevant to the description are omitted for the simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element.

Through the whole document, the term "on" that is used to designate a position of one element with respect to another element includes both a case that the one element is adjacent to the another element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise. Through the whole document, the term "about or approximately" or "substantially" is intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for".

The present disclosure relates to a container locking device 100.

Figure 2:
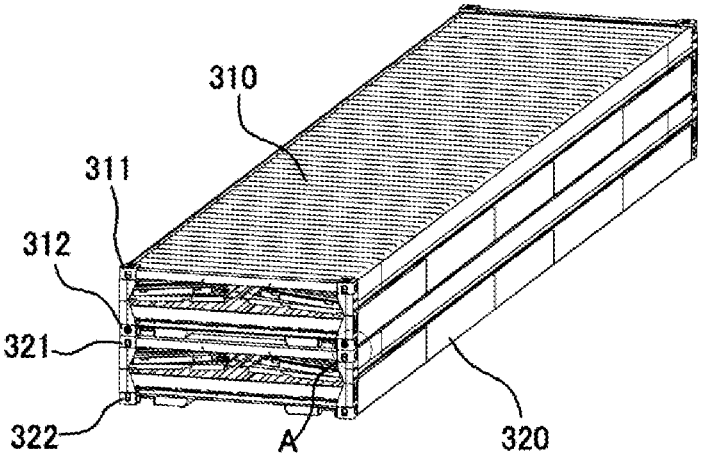
FIG. 2 is a diagram provided to explain a container locking device to be used for a collapsible container in accordance with an exemplary embodiment of the present disclosure.
Figure 3:
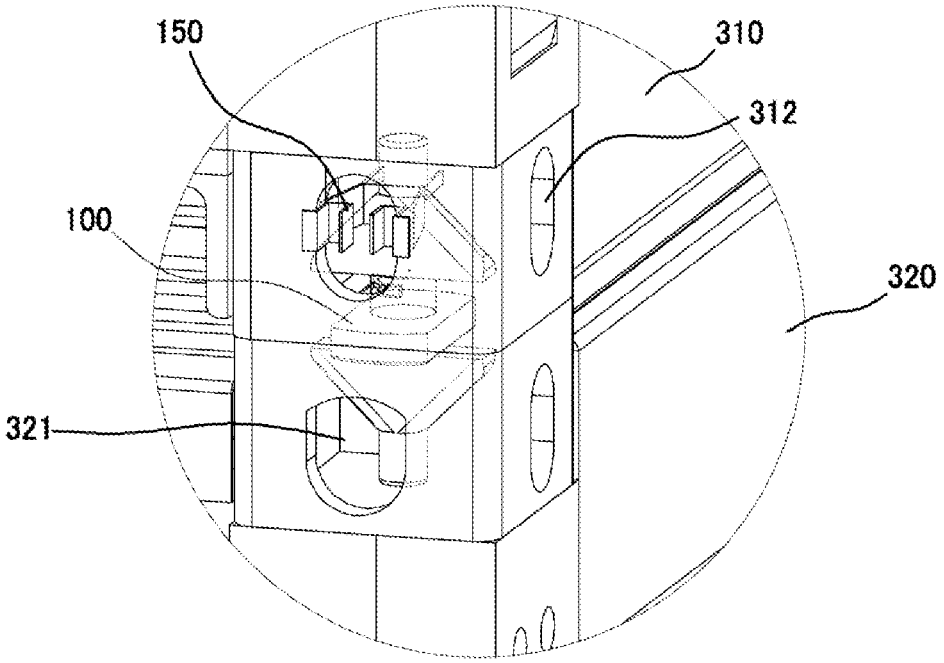
FIG. 3 is an enlarged view of area A in FIG. 2.
Figure 4:
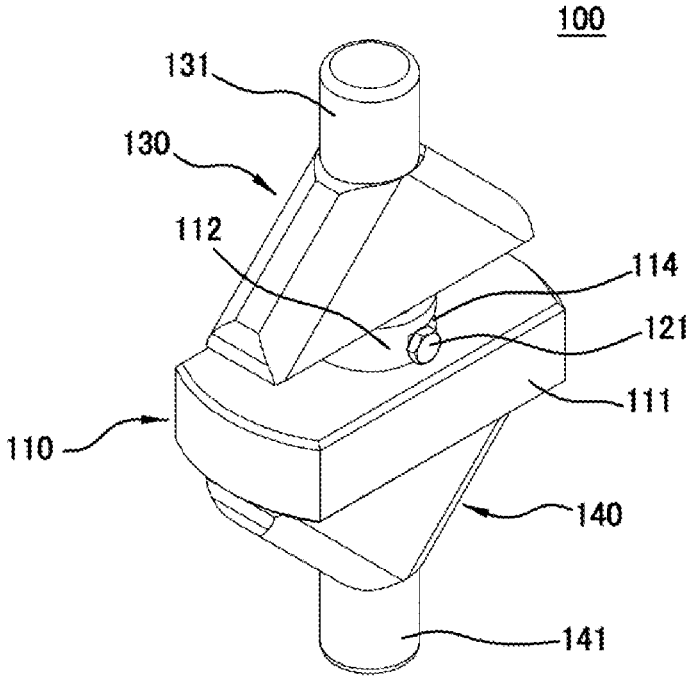
FIG. 4 is a perspective view of a container locking device in accordance with an exemplary embodiment of the present disclosure.
Figure 5A:
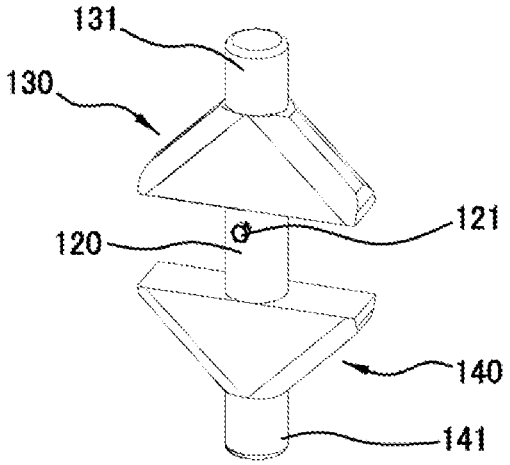
FIGS. 5A and 5B are an exploded perspective view of a container locking device in accordance with an exemplary embodiment of the present disclosure.
Figure 5B:
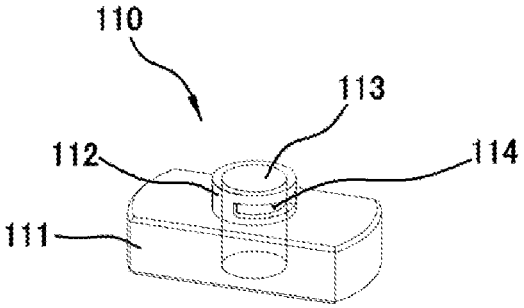
Figure 6:
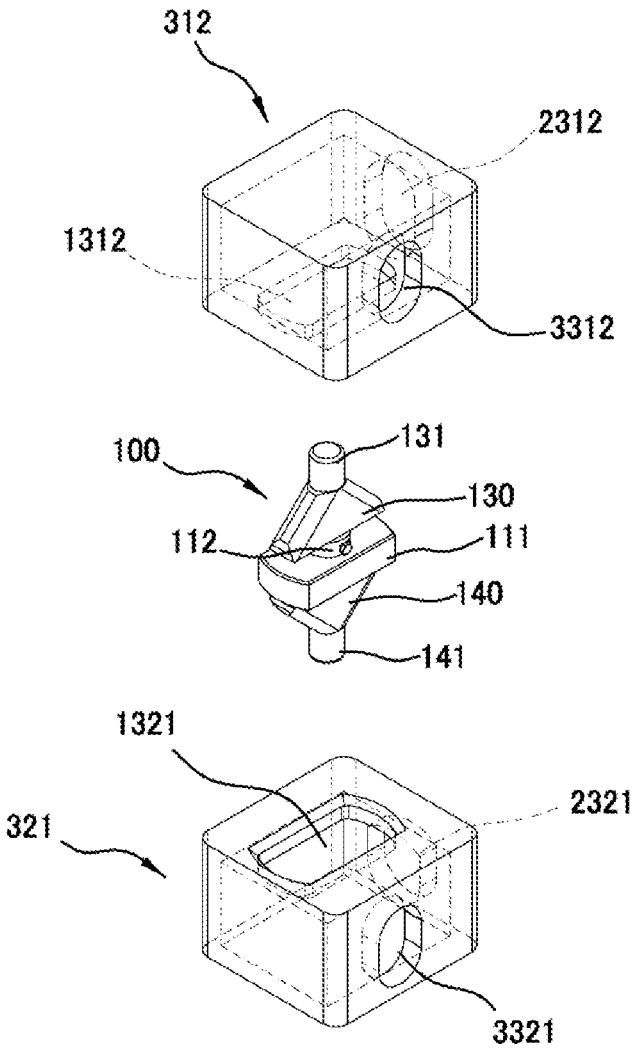
FIG. 6 is an exemplary view illustrating connection of a container locking device in accordance with an exemplary embodiment of the present disclosure.
Figure 7A:
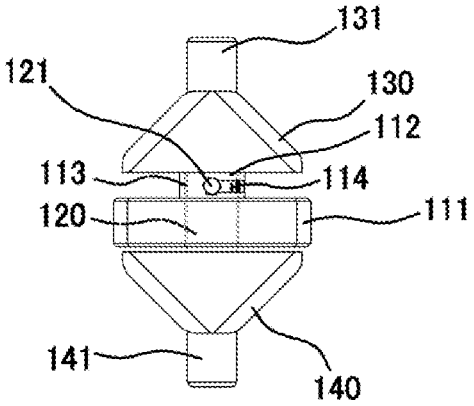
FIGS. 7A and 7B provide a front view and a side view of a container locking device in accordance with an exemplary embodiment of the present disclosure.
Figure 7B:
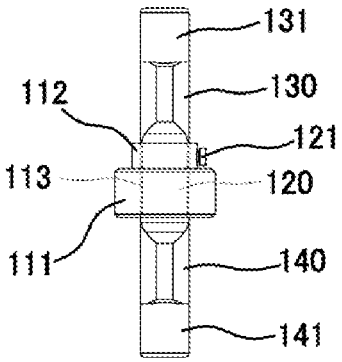
Figure 8A:
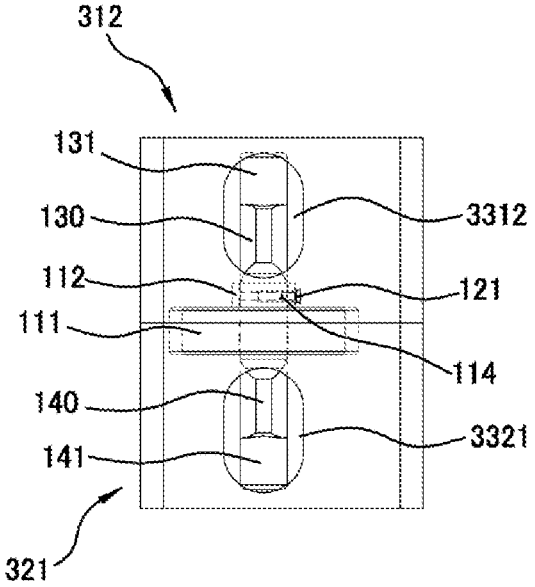
FIGS. 8A and 8B provide a front view and a side view illustrating a status where a container locking device in accordance with an exemplary embodiment of the present disclosure is inserted into a corner fitting of a container.
Figure 8B:
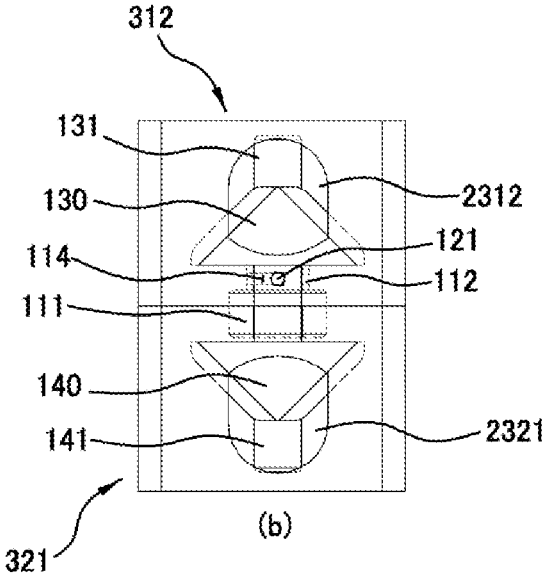
Figure 9A:
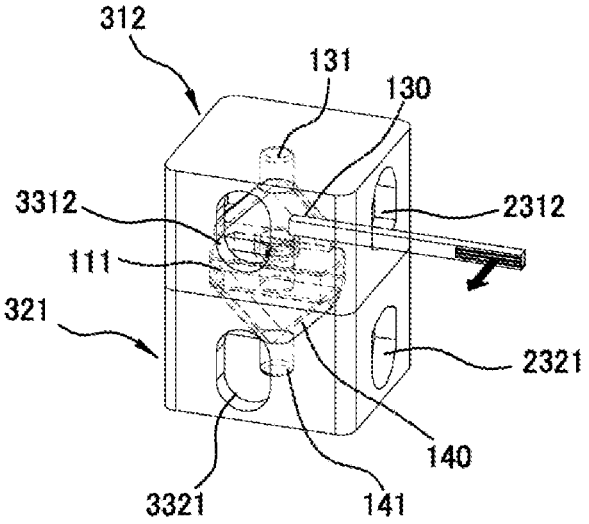
FIGS. 9A and 9B are an exemplary view illustrating an operation of a container locking device in accordance with an exemplary embodiment of the present disclosure.
Figure 9B:
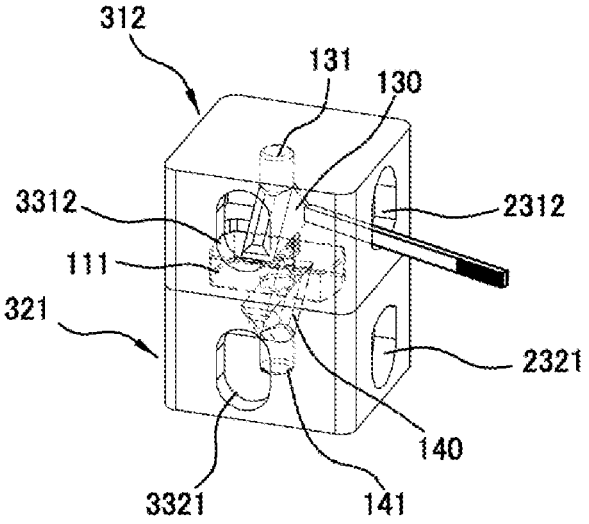
Figure 10:
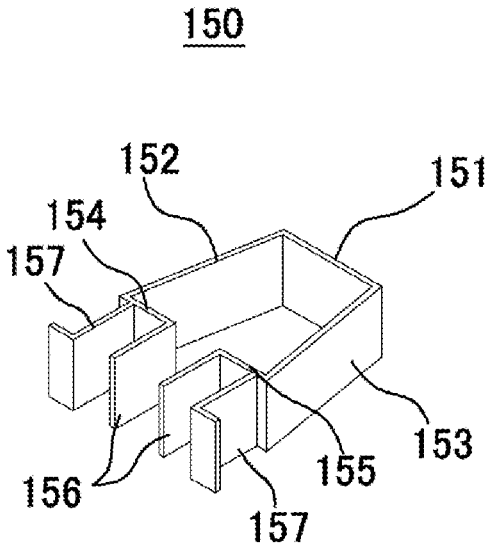
FIG. 10 is a perspective view of a fastening fixing unit in accordance with a first exemplary embodiment of the present disclosure.
Figure 11:
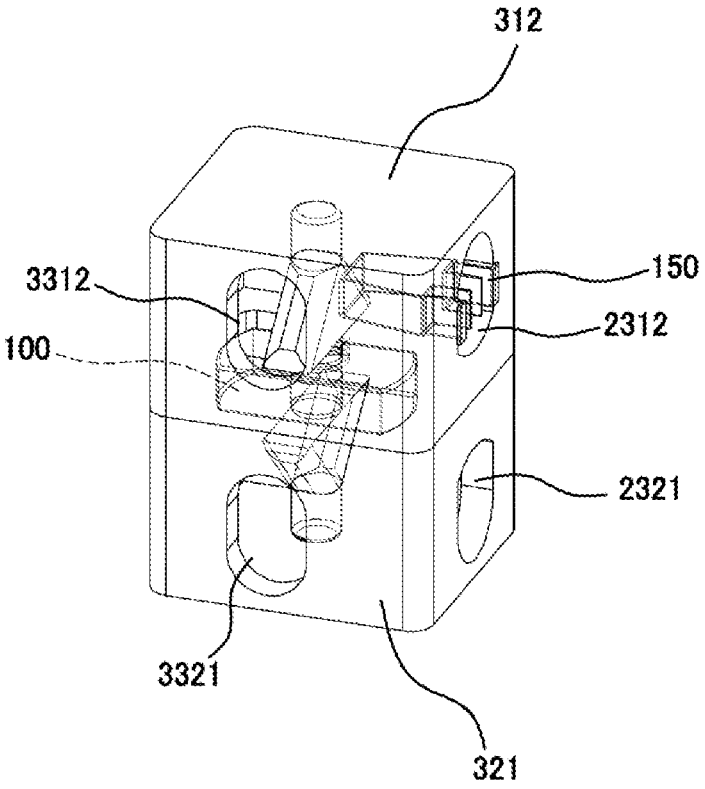
FIG. 11 is an exemplary view illustrating connection of the fastening fixing unit and a container locking device in accordance with the first exemplary embodiment of the present disclosure.
Figure 12A:
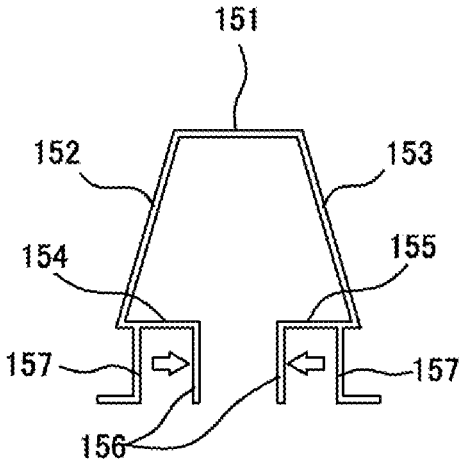
FIGS. 12A and 12B are an exemplary view illustrating an operation of the fastening fixing unit in accordance with the first exemplary embodiment of the present disclosure.
Figure 12B:
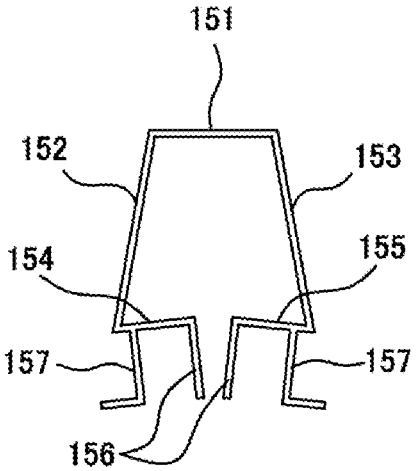
Figure 13A:
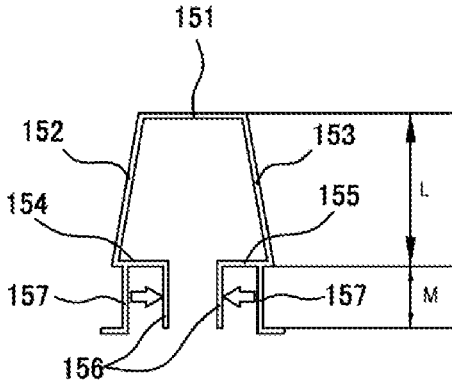
FIGS. 13A and 13B are diagrams provided to restrict the size of the fastening fixing unit in accordance with the first exemplary embodiment of the present disclosure.
Figure 13B:
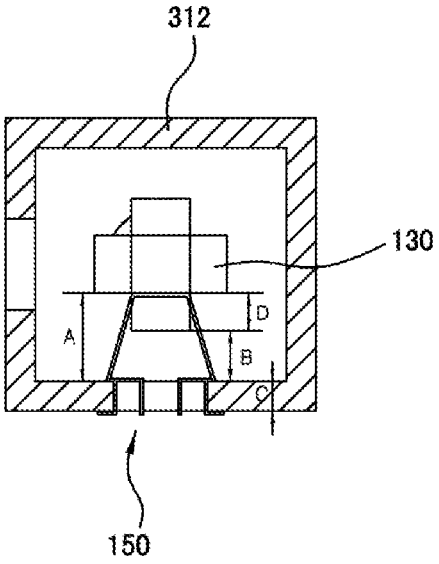
Figure 14:
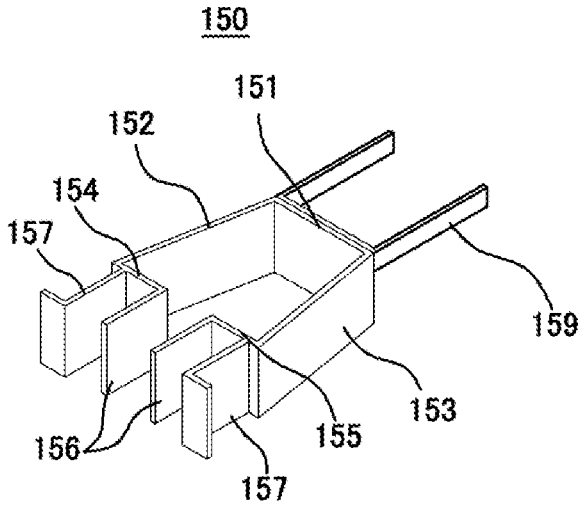
FIG. 14 is a perspective view of a fastening fixing unit in accordance with a second exemplary embodiment of the present disclosure.
Figure 15:
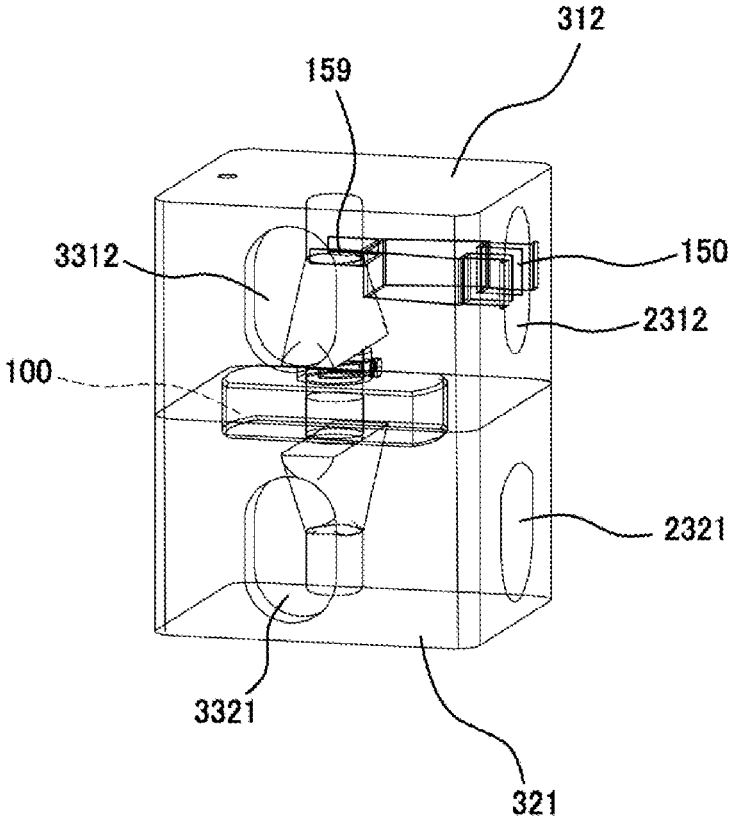
FIG. 15 is an exemplary view illustrating connection of the fastening fixing unit and a container locking device in accordance with the second exemplary embodiment of the present disclosure.
Figure 16:
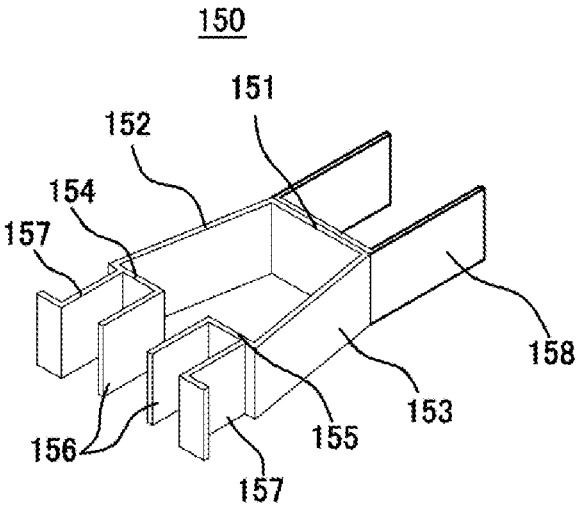
FIG. 16 is a perspective view of a fastening fixing unit in accordance with a third exemplary embodiment of the present disclosure.
Figure 17:
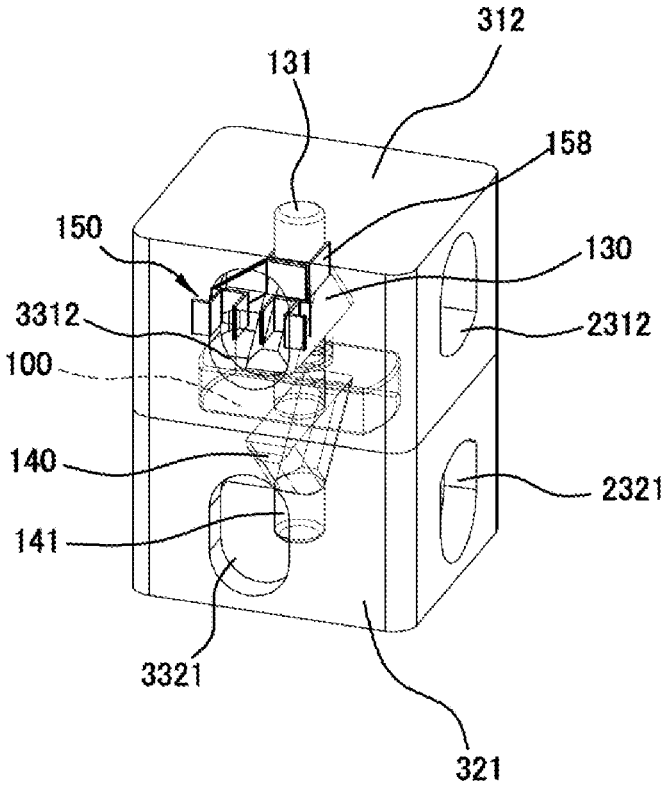
FIG. 17 is an exemplary view illustrating connection of the fastening fixing unit and a container locking device in accordance with the third exemplary embodiment of the present disclosure.

FIG. 1 is a perspective view of a container, FIG. 2 is a diagram provided to explain a container locking device to be used for a collapsible container in accordance with an exemplary embodiment of the present disclosure, FIG. 3 is an enlarged view of area A in FIG. 2, FIG. 4 is a perspective view of a container locking device in accordance with an exemplary embodiment of the present disclosure, FIGS. 5A and 5B are an exploded perspective view of a container locking device in accordance with an exemplary embodiment of the present disclosure, FIG. 6 is an exemplary view illustrating connection of a container locking device in accordance with an exemplary embodiment of the present disclosure, FIGS. 7A and 7B provide a front view and a side view of a container locking device in accordance with an exemplary embodiment of the present disclosure, FIGS. 8A and 8B provide a front view and a side view illustrating a status where a container locking device in accordance with an exemplary embodiment of the present disclosure is inserted into a corner fitting of a container, FIGS. 9A and 9B are an exemplary view illustrating an operation of a container locking device in accordance with an exemplary embodiment of the present disclosure, FIG. 10 is a perspective view of a fastening fixing unit in accordance with a first exemplary embodiment of the present disclosure, FIG. 11 is an exemplary view illustrating connection of the fastening fixing unit and a container locking device in accordance with the first exemplary embodiment of the present disclosure, FIGS. 12A and 12B are an exemplary view illustrating an operation of the fastening fixing unit in accordance with the first exemplary embodiment of the present disclosure, FIGS. 13A and 13B are diagrams provided to restrict the size of the fastening fixing unit in accordance with the first exemplary embodiment of the present disclosure, FIG. 14 is a perspective view of a fastening fixing unit in accordance with a second exemplary embodiment of the present disclosure, FIG. 15 is an exemplary view illustrating connection of the fastening fixing unit and a container locking device in accordance with the second exemplary embodiment of the present disclosure, FIG. 16 is a perspective view of a fastening fixing unit in accordance with a third exemplary embodiment of the present disclosure, and FIG. 17 is an exemplary view illustrating connection of the fastening fixing unit and a container locking device in accordance with the third exemplary embodiment of the present disclosure.

Prior to a container locking device 100 of the present disclosure, a container 300 will be described with reference to FIG. 1.

The container 300 is manufactured to have a cubic shape, and includes a lower panel 301, an upper panel 302 provided in parallel with the lower panel 301 lateral panels 303 connected to the upper panel 302 and the lower panel 301 along a longitudinal direction of the upper panel 302 and the lower panel 301, and a front panel 304 and a rear panel 305 connected to the upper panel 302 and the lower panel 301 along a transverse direction thereof. Further, the container 300 includes corner fittings 306 and 307 at its corners, respectively.

The corner fittings 306 and 307 include upper corner fittings 306 positioned at the respective corners of the upper panel 302 and lower corner fittings 307 positioned at the respective corners of the lower panel 301.

If the containers 300 are stored or transported as stacked, a device for connecting the container 300 and the container 300 and fixing them not to fall down by external vibrations or shocks is needed.

Referring to FIG. 2 and FIG. 3, the container locking device 100 of the present disclosure may be inserted into a lower corner fitting 312 of a first container 310 positioned on an upper end (hereinafter, referred to as "first container 310") and an upper corner fitting 321 of a second container 320 positioned on a lower end (hereinafter, referred to as "second container 320"), and, thus, the first container 310 and the second container 320 can be fastened to each other. In other words, each container locking device 100 of the present disclosure may be positioned between four lower corner fittings 312 respectively positioned at corners of a lower panel of the first container 310 and four upper corner fittings 321 respectively positioned at corners of an upper panel of the second container 320, and, thus, the first container 310 and the second container 320 can be fastened to each other. That is, the first container 310 and the second container 320 can be connected to each other by four container locking devices 100.

Further, if multiple collapsible containers are stacked as folded and then transported and stored in a bundle as illustrated in FIG. 2, the container locking device 100 of the present disclosure may connect the folded collapsible containers to each other.

For example, an upper part of the container locking device 100 of the present disclosure may be inserted into the lower corner fitting 312 of the first container 310 and a lower part thereof may be inserted into the upper corner fitting 321 of the second container 320, and, thus, the first container 310 and the second container 320 can be connected to each other.

Further, the present container locking device 100 may connect multiple collapsible containers stacked as folded to make a bundle. For example, the present container locking device 100 may connect folded collapsible containers to each other to make the total height of multiple collapsible containers connected as folded similar to the height of an unfolded container.

Furthermore, the present container locking device 100 may further include a fastening fixing unit 150 to suppress unfastening caused by rotation of an upper cone 130 and a lower cone 140 of the container locking device 100. Details thereof will be described latera.

Hereinafter, the container locking device 100 according to an exemplary embodiment of the present disclosure (hereinafter, referred to as "present container locking device 100") will be described in detail with reference to FIG. 4 to FIG. 8.

Referring to FIG. 4 to FIG. 5B, the present container locking device 100 includes: a housing 110 including a base part 111 having a plate shape, a protrusion 112 protruded upwards from an upper surface of the base part 111, and a through hole 113 formed by penetrating the base part 111 and the protrusion 112 in a vertical direction; a connection part 120 rotatably inserted into the through hole 113 of the housing 110; the upper cone 130 positioned on the connection part 120 and inserted into a lower corner fitting 312 of the first container 310; and the lower cone 140 positioned under the connection part 120 and inserted into an upper corner fitting 321 of the second container 320.

Referring to FIG. 6, connection holes 1312 and 1321 are bored in an upper surface of the upper corner fitting 321 of the second container 320 and a lower surface of the lower corner fitting 312 of the first container 310, respectively, so that the present container locking device 100 can be inserted thereto.

In other words, the upper cone 130 and the protrusion 112 of the present container locking device 100 may be inserted into the connection hole 1312 of the lower corner fitting 312 of the first container 310 and the lower cone 140 may be inserted into the connection hole 1321 of the upper corner fitting 321 of the second container 320. Further, the base part 111 may be inserted into the upper corner fitting 321 of the second container 320 and extended to the inside of the lower corner fitting 312 of the first container 310.

More specifically, referring to FIG. 6, the upper corner fitting 321 of the second container 320 may be positioned under the present container locking device 100 and the lower corner fitting 312 of the first container 310 may be positioned on the present container locking device 100.

Further, the upper corner fitting 321 may have a predetermined space therein and include the connection hole 1321 bored in the upper surface formed in parallel with the upper panel 302, a front hole 2321 bored in a front surface formed in parallel with the front panel 304 and the rear panel 305, and a lateral hole 3321 bored in a lateral surface formed in parallel with the lateral panels 303.

Furthermore, the lower corner fitting 312 may have a predetermined space therein and include the connection hole 1312 bored in the lower surface formed in parallel with the lower panel 301, a front hole 2312 bored in a front surface formed in parallel with the front panel 304 and the rear panel 305, and a lateral hole 3312 bored in a lateral surface formed in parallel with the lateral panels 303.

The connection hole 1321 formed in the upper surface of the upper corner fitting 321 may be formed to have a greater width in a longitudinal direction than a width in a transverse direction. Further, a width of the lower cone 140 in a longitudinal direction may be smaller than the width of the connection hole 1321 in the longitudinal direction and greater than the width of the connection hole 1321 in the transverse direction. Therefore, the lower cone 140 may be inserted into the space within the upper corner fitting 321 through the connection hole 1321 and rotated to be fastened to the upper corner fitting 321.

Further, the lower cone 140 may be formed to be gradually narrowed toward the bottom thereof and thus can be easily inserted into the connection hole 1321 of the upper corner fitting 321.

The connection hole 1312 formed in the lower surface of the lower corner fitting 312 may be formed to have a greater width in a longitudinal direction than a width in a transverse direction. Further, a width of the upper cone 130 in a longitudinal direction may be smaller than the width of the connection hole 1312 in the longitudinal direction and greater than the width of the connection hole 1312 in the transverse direction. Therefore, the upper cone 130 may be inserted into the space within the lower corner fitting 312 through the connection hole 1312 and rotated to be fastened to the lower corner fitting 312.

Further, the upper cone 130 may be formed to be gradually narrowed toward the top thereof and thus can be easily inserted into the connection hole 1312 of the lower corner fitting 312.

The above-described "longitudinal direction" may refer to the 2 o'clock and 8 o'clock directions in FIG. 6, and the above-described "transverse direction" may refer to the 4 o'clock and 10 o'clock directions in FIG. 6.

Referring to FIGS. 8A and 8B, an upper portion of the base part 111 is inserted into the connection hole 1312 of the lower corner fitting 312 of the first container 310, and a lower portion of the base part 111 is inserted and fixed to the connection hole 1321 of the upper corner fitting 321 of the second container 320.

In other words, if the first container 310 is stacked on the second container 320, the base part 111 can be fully inserted into the connection holes 1312 and 1321 of the corner fittings 312 and 321. Therefore, the upper surface of the upper corner fitting 321 of the second container 320 can be brought into close contact with the lower surface of the lower corner fitting 312 of the first container 310 and the containers can be fastened to each other without an empty space, and, thus, it is possible to maximize space utilization.

Further, since the base part 111 is inserted into the connection hole 1312 of the lower corner fitting 312 of the first container 310 and the connection hole 1321 of the upper corner fitting 321 of the second container 320, it is possible to suppress forward and backward and left and right movements of the containers and thus possible to securely fasten the containers.

Referring to FIG. 4 to FIG. 5B, the upper cone 130 may include an upper protrusion 131 protruded upwards on its end, and the lower cone 140 may include a lower protrusion 141 protruded downwards on its end.

For example, the upper protrusion 131 may have a cylindrical shape with a flat upper surface, and the lower protrusion 141 may have a cylindrical shape with a flat lower surface.

When the lower cone 140 is inserted into the upper corner fitting 321 of the second container 320, the lower protrusion 141 may be brought into contact with an internal lower surface of the upper corner fitting 321 of the second container 320 and thus may support the container locking device to stably stand upright and may support the upper portion of the base part 111 to be partially protruded toward an upper portion of the upper corner fitting 321.

When the upper cone 130 is inserted into the lower corner fitting 312 of the first container 310, the upper protrusion 131 may be brought into contact with an internal upper surface of the lower corner fitting 312 of the first container 310 and thus may suppress inclination of the containers or deviation of the container locking device 100 from a predetermined position by vibrations or shocks even when the containers are not fastened by the container locking device 100.

Referring to FIGS. 7A and 7B, an upper edge and a lower edge of the base part 111 may be chamfered along the circumference. Therefore, the base part 111 can be easily inserted into the connection hole 1312 of the lower corner fitting 312 and the connection hole 1321 of the upper corner fitting 321.

Referring to FIG. 4 to FIG. 5B, the present container locking device 100 may include a rotation locked part 121 positioned on a circumferential surface of the connection part 120 and a rotation locking groove 114 to which the rotation locked part 121 is inserted and which is formed on a circumferential surface of the protrusion 112.

Referring to FIGS. 7A and 7B, the rotation locked part 121 may penetrate the rotation locking groove 114 to be connected to the connection part 120, and the rotation locking groove 114 may be positioned on a flat surface perpendicular to a rotation axis of the connection part 120 along the circumferential surface of the protrusion 112 and may be formed at an angle of 90 degrees.

Therefore, the connection part 120 can be rotated to the left and right by 90 degrees around the rotation axis, and as the connection part 120 is rotated, the upper cone 130 and the lower cone 140 can be rotated.

In other words, referring to FIGS. 8A and 8B, in a state where the upper cone 130 is inserted into the connection hole 1312 of the lower corner fitting 312 of the first container 310 and the lower cone 140 is inserted into the connection hole 1321 of the upper corner fitting 321 of the second container 320, the connection part 120 can be rotated between a locking position at which the cones cannot be separated from the connection holes 1312 and 1321 and a release position at which the cones can be separated from the connection holes 1312 and 1321.

For example, as illustrated in FIGS. 9A and 9B, in order to rotate the upper cone 130 and the lower cone 140 from the release position to the locking position, a user may insert a rod-shaped tool through the front holes 2312 and 2321 to push one end of the upper cone 130 or lower cone 140 and thus rotate the upper cone 130 and the lower cone 140.

Further, in order to rotate the upper cone 130 and the lower cone 140 from the locking position to the release position, the user may insert the rod-shaped tool through the lateral holes 3312 and 3321 to push one end of the upper cone 130 or lower cone 140 and thus rotate the upper cone 130 and the lower cone 140.

The fastening fixing unit 150 in accordance with a first exemplary embodiment of the present disclosure will be described with reference to FIG. 10.

After the present container locking device 100 is fastened to the upper corner fitting 321 of the second container 320 and the lower corner fitting 312 of the first container 310, the fastening fixing unit 150 may be inserted and fixed to the front hole 2312 or 2321 of the upper corner fitting 321 or the lower corner fitting 312 to fix the upper cone 130 or the lower cone 140 not to be rotated.

The fastening fixing unit 150 may include a front plate 151 having a rectangular shape, a first inclined plate 152 and a second inclined plate 153 respectively extended from both ends of the front plate 151 and bent inwards, a first rear plate 154 extended from the first inclined plate 152 and bent inwards in parallel with the front plate 151, a second rear plate 155 extended from the second inclined plate 153 and bent inwards in parallel with the front plate 151, and a bending fixing part 157 positioned on an outer surface of each of the first rear plate 154 and the second rear plate 155 and bent into a "¬" shape.

The above-described "inwards" may refer to a direction in which an inner surface of the fastening fixing unit 150 is positioned.

The fastening fixing unit 150 may be formed to be gradually decreased in width from the rear plates 154 and 155 toward the front plate 151, and may have, for example, a trapezoidal shape.

Referring to FIGS. 13A and 13B, a distance L from the front plate 151 to the rear plates 154 and 155 may satisfy the following Equation 1.

$$B<L\leq A \qquad \text{[Equation 1]}$$

L: Distance from the front plate to the rear plates

A: Distance from the upper cone or lower cone rotated to the locking position to an inner surface of a front portion of the upper corner fitting or lower corner fitting B: Distance from the upper cone or lower cone rotated to the release position to the inner surface of the front portion of the upper corner fitting or lower corner fitting Accordingly, if the fastening fixing unit 150 is fixed to the front hole 2312 or 2321 of the upper corner fitting 321 or the lower corner fitting 312, the front plate 151 may be brought into contact with one surface of the upper cone 130 or lower cone 140 and the rear plates 154 and 155 may be brought into an inner surface of the upper corner fitting 321 or lower corner fitting 312 to fix the upper cone 130 and the lower cone 140 not to be rotated.

The fastening fixing unit 150 may be formed of a material having a predetermined elasticity and thus may be deformed by force applied to a grip part 156, which will be described later, and inserted into the front hole 2312 or 2321 of the upper corner fitting 321 or the lower corner fitting 312 and then may be returned to its original form by removing the force and fixed to the front hole 2312 or 2321.

Referring to FIG. 11, the fastening fixing unit 150 may be fixed to the front hole 2312 of the lower corner fitting 312.

In other words, the fastening fixing unit 150 may be inserted through the front hole 2312 of the lower corner fitting 312 of the first container and then deformed into a "⊏" shape by the first rear plate 154 and the bending fixing part 157 or the second rear plate 155 and the bending fixing part 157 and the "⊏"-shaped fastening fixing unit 150 may be fixed to the front hole 2312 of the lower corner fitting 312, but is not limited thereto. The fastening fixing unit 150 may be fixed to the front hole 2321 of the upper corner fitting 321 of the second container.

Referring to FIGS. 13A and 13B, a distance M from one end of the bending fixing part 157 to a bent portion of the bending fixing part 157 may satisfy the following Equation 2.

$$C \leq M < (C+D) \quad \text{[Equation 2]}$$

M: Distance from one end of the bending fixing part to the bent portion of the bending fixing part C: Thickness of the front hole of the upper corner fitting or lower corner fitting D: Difference in distance from the upper cone or lower cone rotated to the locking position and the upper cone or lower cone rotated to the release position to the inner surface of the front portion of the upper corner fitting or lower corner fitting Accordingly, the fastening fixing unit 150 can be securely fixed to the front hole 2312 of the lower corner fitting 312 of the first container.

Referring to FIGS. 12A and 12B, the first rear plate 154 and the second rear plate 155 may include the grip part 156 of which ends are bent outwards.

The above-described "outwards" may refer to refer to a direction in which an outer surface of the fastening fixing unit 150 is positioned.

Further, when the user applies force to the grip part 156 inwards, the first inclined plate 152 and the second inclined plate 153 are contracted inwards around the portions in contact with the front plate 151, and, thus, the fastening fixing unit 150 can be easily inserted into the front holes 2312 and 2321 of the corner fittings 312 and 321.

The fastening fixing unit 150 in accordance with a second exemplary embodiment of the present disclosure will be described with reference to FIG. 14 and FIG. 15.

The fastening fixing unit 150 in accordance with the second exemplary embodiment of the present disclosure may further include a cone mounting part 159 which is connected to the front plate 151, formed into a "⊏" shape, and inserted into the upper protrusion 131 of the upper cone 130 and of which a lower surface is brought into contact with an upper portion of the upper cone 130.

If the fastening fixing unit 150 in accordance with the second exemplary embodiment of the present disclosure is fixed to the front hole 2321 of the upper corner fitting 321, the cone mounting unit 159 may be inserted into the upper protrusion 131 and the lower surface of the cone mounting unit 159 may be brought in contact with the upper portion of the upper cone 130, and, thus, the fastening fixing unit 150 can be fixed without being sagged downwards by gravity.

The fastening fixing unit 150 in accordance with a third exemplary embodiment of the present disclosure will be described with reference to FIG. 16 and FIG. 17.

After the present container locking device 100 is fastened to the upper corner fitting 321 of the second container 320 and the lower corner fitting 312 of the first container 310, the fastening fixing unit 150 in accordance with the third exemplary embodiment of the present disclosure may be inserted and fixed to the lateral hole 3312 or 3321 of the upper corner fitting 321 or the lower corner fitting 312 to fix the upper cone 130 or the lower cone 140 not to be rotated.

To this end, the fastening fixing unit 150 in accordance with the third exemplary embodiment of the present disclosure may further include a cone insertion part 158 which is connected to the front plate 151 and formed into a "⊏" shape and to which the upper cone 130 or lower cone 140 is inserted.

In other words, if the fastening fixing unit 150 in accordance with the third exemplary embodiment of the present disclosure is fixed to the lateral hole 3312 or 3321 of the upper corner fitting 321 or the lower corner fitting 312, the upper cone 130 positioned under the upper protrusion 131 or the lower cone 140 positioned on the lower protrusion 141 may be inserted into the cone insertion part 158 to fix the upper cone 130 and the lower cone 140 not to be rotated.

An outer circumferential surface of the fastening fixing unit 150 may be painted in a different color from a container.

Therefore, if multiple containers are stacked, it is possible to easily distinguish a part which is fastened by the present container locking device 100 and the other part which is not fastened by the present container locking device 100.

For example, a container may be entirely painted orange and the fastening fixing unit 150 may be painted blue. As such, the container and the fastening fixing unit 150 may be painted in complementary colors.

Accordingly, when the fastening fixing unit 150 is inserted and fixed to the corner fitting of the container, the fastening fixing unit 150 can be more distinctly and clearly seen against the color of the container.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

EXPLANATION OF REFERENCE NUMERALS

| | |
|---|---|
| 100: Container locking device | |
| 110: Housing | |
| 111: Base part | 112: Protrusion |
| 113: Through hole | 114: Rotation locking groove |
| 120: Connection part | 121: Rotation locked part |
| 130: Upper cone | 131: Upper protrusion |
| 140: Lower cone | 141: Lower protrusion |
| 150: Fastening fixing unit | |
| 151: Front plate | 152: First inclined plate |
| 153: Second inclined plate | 154: First rear plate |
| 155: Second rear plate | 156: Grip part |
| 157: Bending fixing part | 158: Cone insertion part |
| 159: Cone mounting part | |
| 300: Container | 301: Lower panel |
| 302: Upper panel | 303: Lateral panel |
| 304: Front panel | 305: Rear panel |
| 306: Upper corner fitting | 307: Lower corner fitting |
| 310: First container | 311: Upper corner fitting |
| 312: Lower corner fitting | 1312: Connection hole |
| 2312: Front hole | 3312: Lateral hole |
| 320: Second container | 321: Upper corner fitting |
| 1321: Connection hole | 2321: Front hole |
| 3321: Lateral hole | 322: Lower corner fitting |

We claim:

1. A locking device for containers, comprising:

a housing including a base part, a protrusion protruded upwards from an upper surface of the base part, and a through hole formed by penetrating the base part and the protrusion in a vertical direction;

a connection part rotatably inserted into the through hole of the housing;

an upper cone positioned on the connection part and inserted into a lower corner fitting of a first container positioned on an upper end;

a lower cone positioned under the connection part and inserted into an upper corner fitting of a second container positioned on a lower end; and a fastening fixing unit which is inserted into the lower corner fitting or upper corner fitting to suppress rotation of the upper cone or lower cone, wherein the fastening fixing unit includes a front plate having a rectangular shape, a first inclined plate and a second inclined plate respectively extended from both ends of the front plate and bent outwards, a first rear plate extended from the first inclined plate and bent inwards in parallel with the front plate, a second rear plate extended from the second inclined plate and bent inwards in parallel with the front plate, a bending fixing part positioned on an outer surface of each of the first rear plate and the second rear plate and bent outwards, and a cone insertion part which is connected to the front plate and formed into a U-shape and into which the upper cone or lower cone is inserted, wherein the fastening fixing unit is formed to be gradually decreased in width from the rear plates toward the front plate, wherein the bending fixing part is configured for insertion into a hole of the upper or lower corner fitting when the fastening fixing unit is fixed to the upper or lower corner fitting, wherein, when the upper cone or the lower cone is rotatably positioned in a locked state within the upper or lower corner fitting, the fastening fixing unit is inserted into a hole of the respective upper or lower corner fitting, such that the cone insertion part receives the upper or lower cone therein and engages opposing faces of the cone to prevent rotation of the upper or lower cone, and such that each of the bending fixing parts lockably engages an opposing edge of the hole.

2. The locking device for containers of claim 1, wherein an upper portion of the base part is inserted into the lower corner fitting of the first container, and a lower portion of the base part is inserted into the upper corner fitting of the second container.

3. The locking device for containers of claim 1, wherein the base part is chamfered along an upper edge and a lower edge.

4. The locking device for containers of claim 1, wherein the upper cone includes:

an upper protrusion protruded upwards on its end, and the lower cone includes:

a lower protrusion protruded downwards on its end.

5. The locking device for containers of claim 1, further comprising:

a rotation locked part positioned on a circumferential surface of the connection part; and a rotation locking groove to which the rotation locked part is inserted and which is formed on a circumferential surface of the protrusion.

6. The locking device for containers of claim 1, wherein the first rear plate and the second rear plate each include a grip part.

7. The locking device for containers of claim 1, wherein the fastening fixing unit satisfies the following Equation 1:

$$B<L\leq A$$

L: Distance from the front plate to the rear plates

A: Distance from the upper cone or lower cone rotated to a locking position to an inner surface of the upper corner fitting or lower corner fitting B: Distance from the upper cone or lower cone rotated to a release position to the inner surface of the upper corner fitting or lower corner fitting.

8. The locking device for containers of claim 1, wherein the fastening fixing unit satisfies the following Equation 2:

$$C\leq M<(C+D)$$

M: Distance from one end of the bending fixing part to a bent portion of the bending fixing part C: Thickness of a front hole of the upper corner fitting or lower corner fitting D: Difference in distance from the upper cone or lower cone rotated to a locking position and the upper cone or lower cone rotated to a release position to an inner surface of a front portion of the upper corner fitting or lower corner fitting.

9. The locking device for containers of claim 1, wherein the fastening fixing unit is painted in a different color from a container.

* * * * *